US005080003A

United States Patent [19]

Kappeler

[11] Patent Number: 5,080,003

[45] Date of Patent: Jan. 14, 1992

[54] APPARATUS FOR VENTILATING THE INTERIOR OF HIGH SPEED ELEVATOR CARS

[75] Inventor: Franz Kappeler, Urdorf, Switzerland

[73] Assignee: Inventio AG, Switzerland

[21] Appl. No.: 579,334

[22] Filed: Sep. 7, 1990

[30] Foreign Application Priority Data

Sep. 22, 1989 [CH] Switzerland ..... 03465/89

[51] Int. Cl.[5] ..... B24F 13/00; B66B 9/00

[52] U.S. Cl. ..... 454/68; 187/1 R

[58] Field of Search ..... 98/33.1, 32, 37, 42.01; 187/1 R

[56] References Cited

U.S. PATENT DOCUMENTS

| | | | |
|---|---|---|---|
| 1,872,007 | 8/1932 | Reilly . | |
| 1,941,425 | 12/1933 | Young | 98/33.1 |
| 2,310,414 | 2/1943 | Fritzam . | |
| 2,350,389 | 6/1944 | Coulton . | |
| 2,382,076 | 8/1945 | Leslie | 98/32 |
| 2,532,268 | 11/1950 | Christmann . | |
| 4,184,414 | 1/1980 | Jarnot | 98/37 |
| 4,286,507 | 9/1981 | Dörpmund | 98/32 |

FOREIGN PATENT DOCUMENTS

| | | | |
|---|---|---|---|
| 0098686 | 1/1984 | European Pat. Off. . | |
| 1136804 | 9/1962 | Fed. Rep. of Germany . | |
| 2555930 | 6/1977 | Fed. Rep. of Germany | 98/37 |
| 0776983 | 11/1980 | U.S.S.R. | 187/1 R |
| 0851007 | 7/1981 | U.S.S.R. | 98/37 |

*Primary Examiner*—Albert J. Makay
*Assistant Examiner*—William C. Doerrler
*Attorney, Agent, or Firm*—William J. Clemens

[57] ABSTRACT

An apparatus for ventilating high speed elevator cars during the travel with closed doors includes upper and lower ventilation systems having primary air openings formed in troughs located in the upper and lower portions of the car body. The pressure of the incoming air is relieved and the air is smoothed in steps in air chambers and air channels such that the air flows free of drafts and noiselessly into the interior of the car. The ventilation of the elevator car takes place through the ventilation apparatus in the direction of travel of the car, since both the ventilation systems provide flow through in both directions of travel of the car.

17 Claims, 3 Drawing Sheets

APPARATUS FOR VENTILATING THE INTERIOR OF HIGH SPEED ELEVATOR CARS

BACKGROUND OF THE INVENTION

The present invention concerns elevator cars and, in particular, an apparatus for ventilating the interior of high speed elevator cars.

Various different state regulations require that air inlet and outlet openings be provided in the lower and upper portions of an elevator car body and that the openings have a cross-sectional area equal to a predetermined percentage of the floor area of the car. A simple and easy prior art solution was to form slots, holes or perforations in at least one side of the car in the lower and upper portions thereof with a direct connection to the outside air.

Car fans also can be utilized for higher air flow demands. U.S. Pat. No. 2,310,414 describes an elevator car having a fan on the car and a specially constructed air guide channel Horizontal slots are formed in the lower portion of the car for the air outlet.

The above mentioned solutions are not usable for high speed cars because direct connections with the outside air produce noises and drafts and because a fan additionally produces its own noise which can be kept within tolerable limits only by expensive measures. Furthermore, the slip stream and pressure build-up occurring at high speeds have the consequence of an appreciable impairment of the ventilator function.

SUMMARY OF THE INVENTION

The present invention is based on the task of creating a noiseless and draft-free car ventilation apparatus which does not display the above mentioned disadvantages and still functions unobjectionably at higher car speeds of up to 10 meters per second. This problem is solved by the present invention in which the ventilation of the car during the travel with closed doors takes place through the openings of prescribed cross-sectional area present in the upper and lower portions of the car body and wherein a vertical air current arises in the car and is produced by slip stream and pressure build-up at the air-displacing car. The invention operates without a fan whereby the slip stream and pressure build-up operate the ventilation system, and neither inherent noises nor external noises are audible in the car and no drafts arise.

The present invention involves an apparatus for the ventilation of high speed elevator cars in which ventilation of the car interior during the travel with closed doors takes place through openings of predetermined cross-sectional area formed in the upper and lower portions of the car body and wherein a vertical air current flows in the car due to a slip stream and pressure build-up at the air-displacing car. The apparatus includes an upper ventilation system located in an upper portion of an elevator car and a similar lower ventilation system located in a lower portion of the elevator car. Each of the ventilation systems decelerates and relieves an entering air current when the car is travelling in an associated direction, the air current entering a trough having side walls formed in an associated end of the elevator car with a plurality of primary air openings formed in at least one side wall of the trough. A quarter-round outside panel is attached to the side walls of said trough to form an air chamber connected to the primary air openings. A support is attached to the outside panel and to an outside car wall and has a plurality of said secondary air openings formed therein and a wind guide plate is positioned between the air chamber and the secondary air openings. The wind guide plate is attached to the support to form a U-shaped air channel connected between the air chamber and the secondary air openings. An air inlet opening is connected between the secondary air openings and an interior of the car and the support and the outside car wall form a vertical air channel connected between the secondary air openings and the air inlet opening to complete the flow path for the ventilation air. Thus, air flows through the ventilation system from the primary air openings into the air chamber, through the U-shaped air channel, through the secondary air openings into the vertical air channel, and through the air inlet opening into the car.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
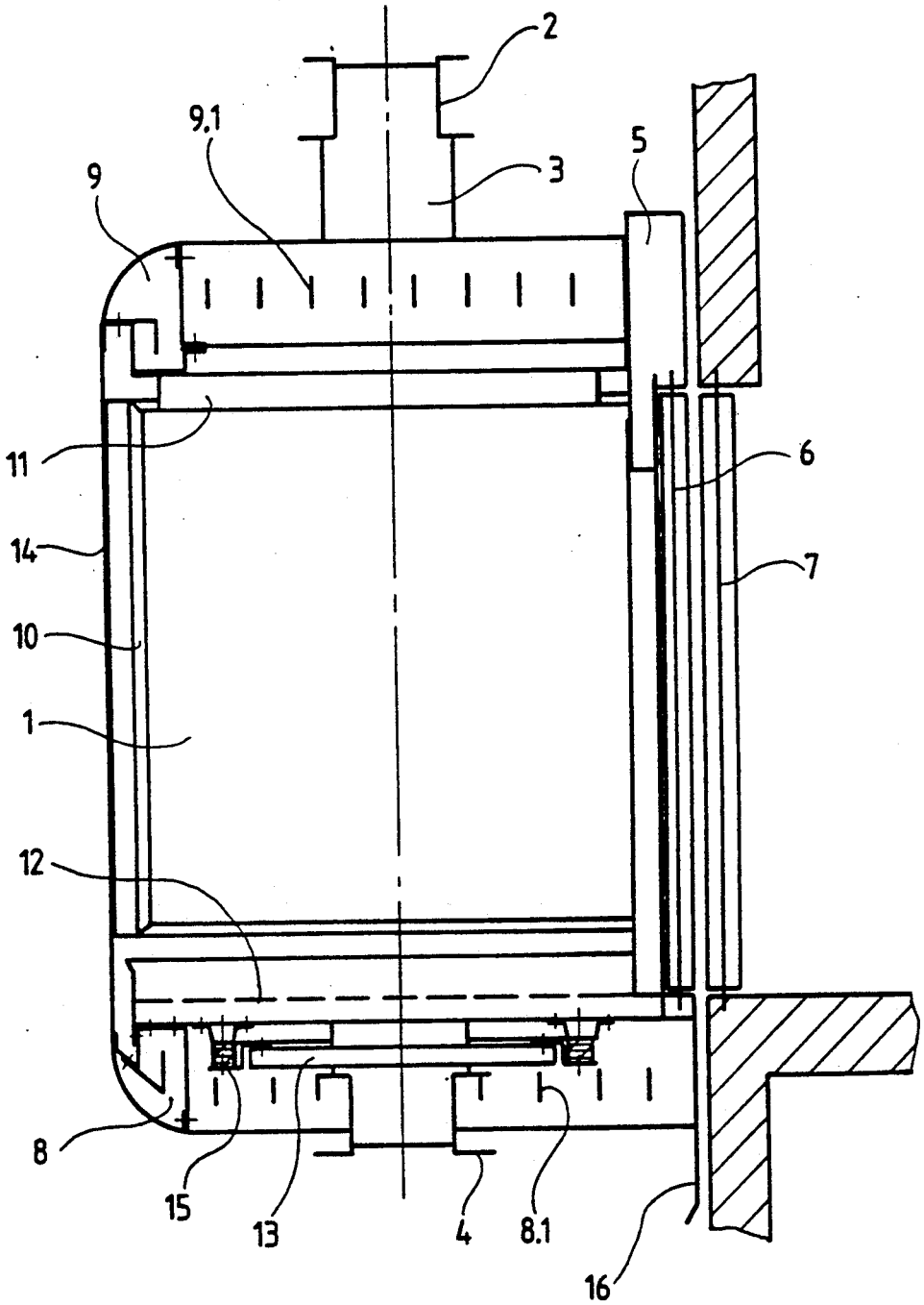
FIG. 1 is a cross-sectional view of an elevator car incorporating a ventilation apparatus in accordance with the present invention.

There is shown in the FIG. 1 an elevator car 1 having an upper yoke 2, a lower yoke 4 and side plates 3 for support in an elevator shaft. A door drive 5 mounted on the car actuates a car door 6. A shaft door 7 is situated at each of the floors. The car body is supported by rubber bumpers 15 mounted on a support crossbeam 13 and includes a car floor 12, a ceiling lamp 11 and internal wall panels 10. The elevator car 1 has an outside car wall 14, a ventilation system 8 at the bottom of the car below the floor 12 and a ventilation system 9 at the top of the car above the lamp 11. A skirt 16 is attached to the car 1 at the bottom on the door side. A plurality of primary air openings at the bottom of the car are indicated by 8.1 and a plurality of primary air openings at the top of the car are indicated by 9.1.

Figure 2:
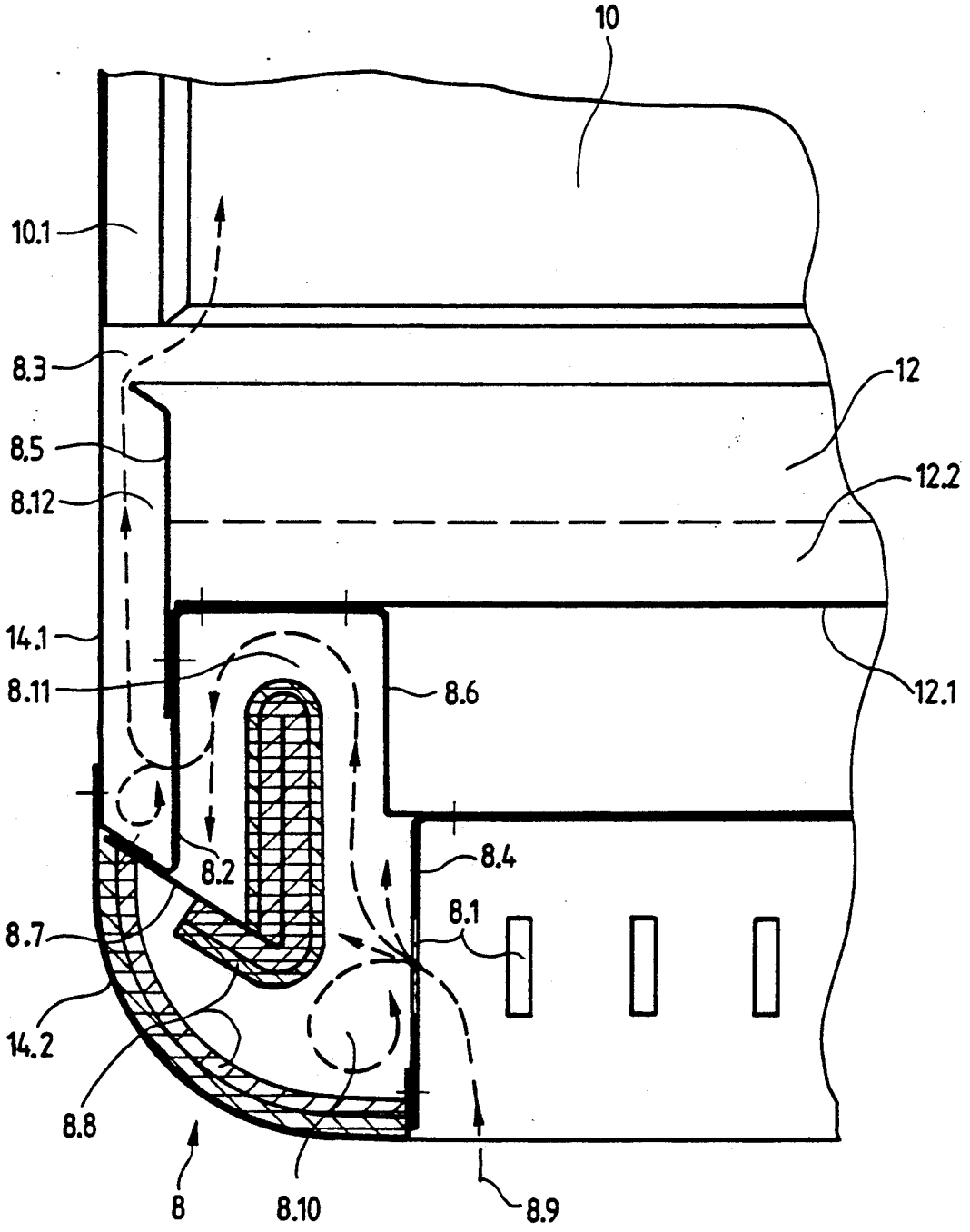
FIG. 2 is an enlarged fragmentary view of the lower ventilation system portion of the ventilation apparatus shown in FIG. 1.

As shown in the FIG. 2, the lower ventilation system 8 is enclosed by a quarter-round outside panel 14.2 attached at an horizontally extending lower edge to an angle bracket 8.4 which is attached at a vertically extending upper edge to an inverted U-shaped support 8.6. The support 8.6 is attached to and a pedestal 8.5. The quarter-round outside panel 14.2, at the lower edge, has a right-angle upwardly bent flange to which a lower edge of a vertically extending leg of the angle bracket 8.4 is fastened. The primary air openings 8.1 are formed in the shape of vertically extending rectangular slots arranged in a row in the vertically extending leg of the angle bracket 8.4. A short horizontally extending leg of the angle bracket 8.4 is attached to an horizontally extending flange formed at a lower edge of a right-hand vertically extending leg of the U-shaped support 8.6. Formed in a left-hand vertically extending leg of the U-shaped support 8.6 are a plurality of secondary air openings 8.2, which openings are arranged similar to the primary air openings 8.1, but have a greater cross sectional area than the openings 8.1. A lower edge of a vertically extending wall of the pedestal 8.5 is fastened to an upper end of the left-hand leg of the U-shaped support 8.6.

An upper horizontally extending wall of the U-shaped support 8.6 is attached to a lower surface of a metal floor plate 12.1 of the car floor 12, which plate carries a floor covering 12.2. A lower edge of the vertically extending left-hand leg of the U-shaped support 8.6 is formed as a flange bent away obliquely upwards toward the outside and attached to an inwardly and downwardly bent lower edge of a vertical panel 14.1 of the outside car wall 14 The lower edge of the panel 14.1 is also attached to the upper edge of the quarter-round outside panel 14.2. The bent flange portion of the left-hand leg of the U-shaped support 8.6 is attached to a V-shaped metal wind guide plate 8.7. The plate 8.7 defines a chamber 8.10 and a U-shaped air channel 8.11 in the space enclosed by the outside panel 14.2, the angle bracket 8.4 and the U-shaped support 8 6 Surfaces of the V-shaped wind guide plate 8.7 and an interior surface of the quarter-round outside panel 14.2 have a damping material layer 8.8 attached thereto A space between an upper edge of the pedestal 8.5, which edge is bent away obliquely upwards at the left, and an inside surface of the outside car wall vertical panel 14.1 form an air inlet opening 8.3. The opening 8.3 is located at an upper end of a vertically extending air channel 8 12 defined between the interior surface of the panel 14.1 and a facing surface of the pedestal 8.5.

An air current 8.9 flows during downward travel of the elevator car through the ventilation system 8 entering the car at the inlet opening 8.3 between the upper edge of the pedestal 8 5 and a lower edge of the car internal panelling 10, which panelling is attached by a mounting 10.1 to the outside car wall 14.

Figure 3:
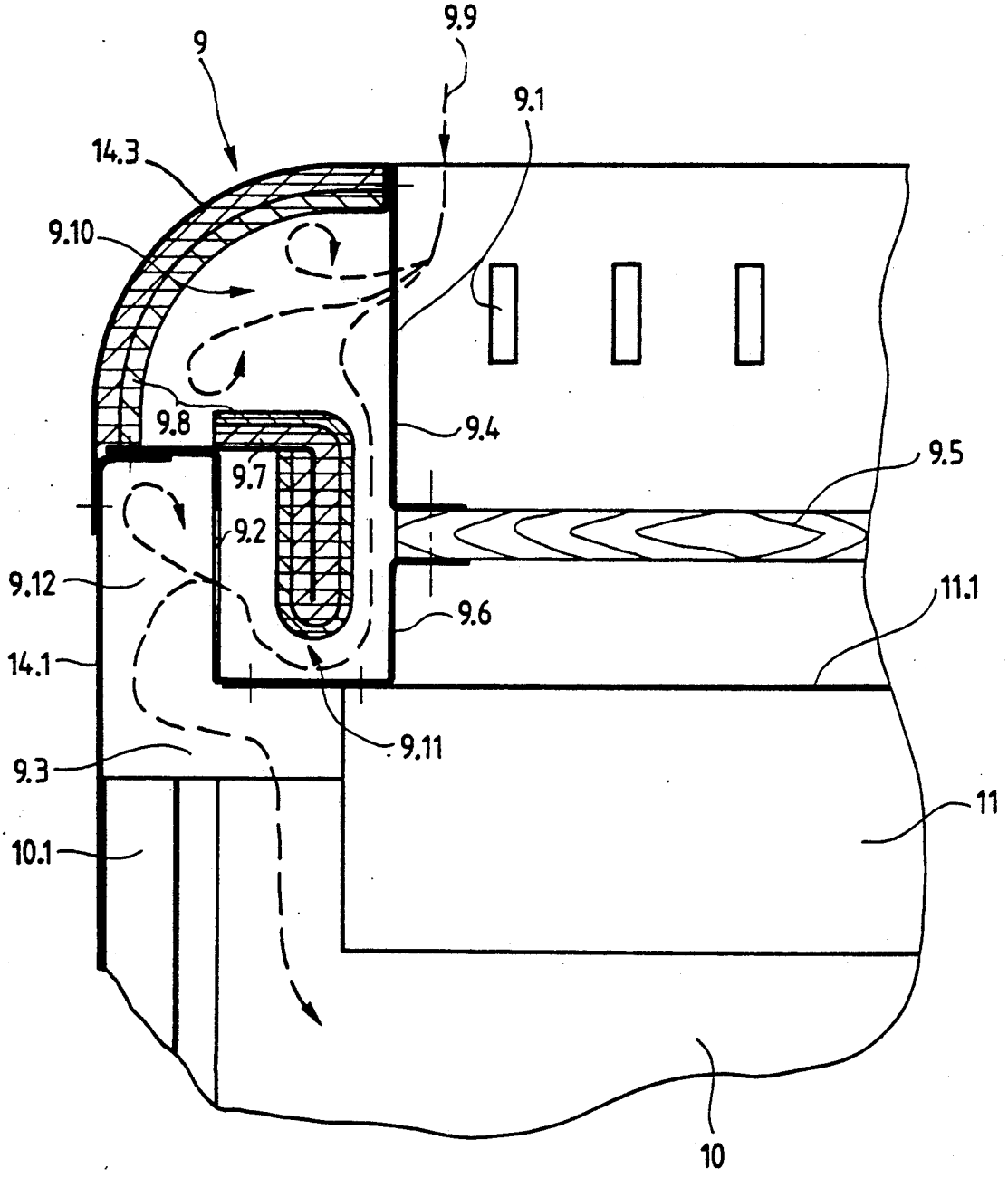
FIG. 3 is an enlarged fragmentary view of the upper ventilation system portion of the ventilation apparatus shown in FIG. 1.

There is shown in the FIG. 3 the upper ventilation system 9 which system is constructed in principle the same as the lower ventilation system 8. An angle bracket 9.4 is fastened at an horizontally extending shorter leg to an upper surface of a ceiling board 9.5 that can support the weight of a human. A vertically extending longer leg of the bracket 9.4 has the plurality of primary air openings 9.1 formed therein arranged as vertically extending rectangular openings in a horizontal row. The longer leg of the angle bracket 9.4 has an upper edge attached to a right-angled bent flange portion of an upper edge of a quarter-round outside panel 14.3. A lower edge of the panel 14.3 overlaps and is fastened to an upper edge of the vertical panel 14.1 of the outside car wall.

An unequal length U-shaped support 9.6 has horizontally outwardly extending short flanges bent over at upper edges of a pair of spaced vertical walls. The left-hand flange is fastened to an inwardly bent upper edge of the outside car wall vertical panel 14.1 as is one leg of a metal wind guide plate 9.7. The guide plate 9.7 is bent at a right angle and subdivides the space enclosed by the angle bracket 9.4, the outside panel 14.3 and the support 9.6 into a chamber 9.10 and a U-shaped air channel 9 11. Secondary air openings 9.2 are formed in the left-hand vertically extending leg of the U-shaped support 9 6 and are arranged similar to the primary air openings 9.1, but have a greater cross sectional area than the primary air openings The flange at the upper end of right-hand leg of the U-shaped support 9.6 is fastened underneath the car ceiling board 9.5. An horizontally extending wall of the support 9.6 is attached to an upper surface 11.1 of the lamp 11.

The wind guide plate 9.7 and an inside surface of the quarter-round outside panel 14.3 are covered by a damping material layer 9.8. The left-hand leg of the U-shaped support 9.6 and a portion of the outside car wall vertical panel 14.1 define a vertical air channel 9.12 with an air inlet opening 9.3. The opening 9.3 is bounded at the left by an upper edge of a mounting 10.1 for the internal panelling 10 and at the right by the car lamp 11. An air current 9.9 flows during upward travel of the elevator car through the ventilation system 9 and enters the car interior at the air inlet opening 9.3.

The above described ventilation apparatus operates as follows: the primary air openings, 8.1 at the bottom and 9.1 at the top, are formed in the vertically extending portions of the angle brackets 8.4 and 9.4 respectively. The arrangement of these angle brackets 8.4 and 9.4 on three sides of the car, together with a rear wall of the door drive 5 at the fourth side, form a trough closed on all sides and, for example, ten to fifteen centimeters deep. During travels of the car at high speeds from about four meters per second, apart from the slipstream, there arises a pronounced pressure build-up which is utilized in a targeted manner in the trough by the described arrangement of the primary air openings 8.1 and 9.1. Due to the increased air pressure arising in the lower trough, for example during downward travel, air is urged through the primary air openings 8.1 and flows from there into the chamber 8.10, in which a smoothing and partial relief of the incoming air pressure takes place. The air then moves in a uniform flow through the air channel 8.11 around the wind guide plate 8.7 and enters through the secondary air openings 8.2 into the vertical air channel 8.12. The sum of the cross-sectional areas of the secondary air openings 8.2 is about twice as great as that of the primary air openings 8.1, which has the consequence of deceleration and partial pressure relief of the incoming air.

The air rises through the vertical air channel 8.12 and enters into the car through the lower air inlet 8.3. The air entry into the car takes place uniformly on all three sides and at very low speed because the entire air inlet cross-sectional area between the upper edge of the pedestal strip 8.5 and the inside surface of the outside car wall vertical panel 14.1 is again about twice as great as that of the secondary air openings 8.2. The noise of the air flowing through the primary air openings 8.1 is suppressed completely within the ventilation system 8 on the one hand by the subsequent two-stage relief and on the other hand by the surfaces covered with the damping material 8.8. Additionally, no outside noises are transmitted through the ventilation system 8 into the interior of the car, because the internal construction of the ventilation system 8 acts as an acoustic labyrinth seal.

The air current 8.9 into the car leaves the interior of the car through the upper ventilation system 9, which is constructed in principle exactly the same as the lower ventilation system 8. The reverse throughflow in this system during downward travel effects a step-wise acceleration of the issuing air. This acceleration and compaction of the issuing air has the consequence of a slight, hardly noticeable pressure increase in the car. This effect is negligible through appropriate design of the ventilation systems 8 and 9. The entire process functions exactly the same during upward travel, however in reverse sequence, since the exterior of the car is in fluid communication with the interior of the car through the primary air openings 8.1 and 9.1, the air chambers 8.10 and 9.10, the U-shaped air channels 8.11 and 9.11, the secondary air openings 8.2 and 9.2, the vertical air channels 8.12 and 9.12 and the air inlet openings 8.3 and 9.3. Then, the trough on the upper side of the car is exposed to the pressure build-up and the air flows downwardly from above following the same path only in reverse.

In a further embodiment, the air can be directed behind the internal panelling 10 and enter the car through any shape of perforations. In that case, a separation of the entering and the issuing air is provided at about half the height of the car.

Furthermore, different arrangements of the air openings are feasible and those surfaces of the angle brackets 8.4 and 9.4, which form the side walls of a trough, can be inclined obliquely inwardly or outwardly instead of being vertical.

The above described principle of operation of a ventilation apparatus also can be applied to road and rail vehicles.

In accordance with the provisions of the patent statutes, the present invention has been described in what is considered to represent its preferred embodiment. However, it should be noted that the invention can be practiced without departing from its spirit or scope.

What is claimed is:

1. An apparatus for the ventilation of high speed elevator cars in which ventilation of the car interior during the travel with closed doors takes place through a plurality of openings of total predetermined cross-sectional area formed in the upper and lower portions of the car body and wherein a vertical air current flows in the car and is produced by slip stream and pressure build-up at the air-displacing car, comprising: an upper ventilation system located in an upper portion of an elevator car and a lower ventilation system located in a lower portion of the car, each said ventilation system permitting air to enter the car and for decelerating and pressure relieving an entering air current during the travel of the car in an associated direction and including a plurality of primary air openings formed in at least one side of the car, means forming an air chamber connected to said primary air openings, means forming secondary air openings connected to said air chamber, a wind guide plate positioned between said air chamber and said secondary air openings and an air inlet opening formed in an interior of the car and connected between said secondary air openings and the interior of the car and wherein said primary air openings are formed in vertically extending surfaces of angle brackets attached to the elevator car.

2. The apparatus according to claim 1 wherein a cross-sectional area of said air inlet opening is greater than a sum of the cross-sectional areas of said secondary air openings and said sum of the cross-sectional areas of said secondary air openings is greater than a sum of the cross-sectional areas of said primary air openings.

3. The apparatus according to claim 1 wherein said ventilation systems each include an air channel connected between said air chamber and said secondary air openings and defined by said wind guide plate.

4. The apparatus according to claim 1 wherein surfaces of walls defining said air chamber within said ventilation systems are covered by a sound damping material layer.

5. The apparatus according to claim 1 wherein a trough is formed on an upper side of the elevator car by vertically extending legs of angle brackets, an upper surface of a ceiling board and a rear wall of a door drive attached to the elevator car.

6. The apparatus according to claim 1 wherein a trough is formed on a lower side of the elevator car by vertically extending legs of angle brackets, a lower surface of a floor plate and an inwardly facing side of a skirt attached to the elevator car.

7. The apparatus according to claim 1 wherein said air inlet opening is formed by an edge of a pedestal spaced inwardly from an outside car wall of the elevator car and an inner surface of said outside car wall.

8. The apparatus according to claim 1 wherein a trough is formed on an upper side of the elevator car by vertically extending legs of angle brackets, an upper surface of a ceiling board and a rear wall of a door drive attached to the elevator car and said primary air openings are formed in said legs.

9. The apparatus according to claim 1 wherein a trough is formed on a lower side of the elevator car by vertically extending legs of angle brackets, a floor plate and an inwardly facing side of a skirt attached to the elevator car and said primary air openings are formed in said legs.

10. An apparatus for the ventilation of high speed elevator cars in which ventilation of the car interior during the travel with closed doors takes place through openings of predetermined cross-sectional area formed in the upper and lower portions of the car body and wherein a vertical air current flows in the car due to a slip stream and pressure build-up at the air-displacing car, comprising:

an upper ventilation system located in an upper portion of an elevator car; and a lower ventilation system located in a lower portion of the elevator car, each said ventilation system permitting air to enter the car and for decelerating and relieving an entering air current when the car is travelling in an associated direction and including a trough having side walls formed in an associated end of the elevator car and a plurality of primary air openings formed in at least one of said side walls of said trough, means forming an air chamber connected to said primary air openings, means forming secondary air openings connected to said air chamber, a wind guide plate positioned between said air chamber and said secondary air openings and an air inlet opening connected between said secondary air openings and an interior of the car.

11. The apparatus according to claim 10 wherein said means forming an air chamber includes a quarter-round outside panel attached to said side walls of said trough.

12. The apparatus according to claim 11 wherein said means forming secondary air openings includes a support attached to said outside panel and an outside car wall and having a plurality of said secondary air openings formed therein.

13. The apparatus according to claim 12 wherein said wind guide plate is attached to said support to form a U-shaped air channel connected between said air chamber and said secondary air openings.

14. The apparatus according to claim 13 wherein said support and said outside car wall form a vertical air channel connected between said secondary air openings and said air inlet opening.

15. An apparatus for the ventilation of high speed elevator cars in which ventilation of the car interior during the travel with closed doors takes place through a plurality of openings of predetermined total cross-sectional area present in the upper and lower portions of the car body and wherein a vertical air current flows in the car and is produced by slip stream and pressure build-up at the air-displacing car, comprising:

an upper ventilation system located in an upper portion of an elevator car and including an upper trough formed by a horizontally extending ceiling board attached to an upper angle bracket having a plurality of upper primary air openings formed therein, an upper outside panel and an upper support attached to said upper angle bracket and said ceiling board respectively and defining an upper air chamber connected to said upper primary air openings, an upper guide plate attached to said upper support and defining an upper U-shaped air channel connected to said upper air chamber, a plurality of upper secondary air openings formed in said upper support and connected to said upper U-shaped air channel, an outside wall of the elevator car attached to said upper support and defining an upper vertical air channel connected to said upper secondary air openings and having an upper air inlet opening connecting said upper vertical air channel with an interior of the car; and a lower ventilation system located in a lower portion of an elevator car and including a lower trough formed by a lower angle bracket having a plurality of lower primary air openings formed therein, a lower outside panel and a lower support attached to said lower angle bracket and defining a lower air chamber connected to said lower primary air openings, a lower guide plate attached to said lower support and defining a lower U-shaped air channel connected to said lower air chamber, a plurality of lower secondary air openings formed in said lower support and connected to said lower U-shaped air channel, an outside wall of the elevator car and a pedestal attached to said upper support and defining a lower vertical air channel connected to said lower secondary air openings and having a lower air inlet opening connecting said lower vertical air channel with an interior of the car.

16. The apparatus according to claim 15 wherein a sum of the cross sectional areas of said upper air inlet openings is greater than a sum of the cross-sectional areas of said upper secondary air openings and said sum of the cross-sectional areas of said upper secondary air openings is greater than a sum of the cross-sectional areas of said upper primary air openings.

17. The apparatus according to claim 15 wherein a sum of the cross sectional areas of said lower air inlet openings is greater than a sum of the cross-sectional areas of said lower secondary air openings and said sum of the cross-sectional areas of said lower secondary air openings is greater than a sum of the cross-sectional areas of said lower primary air openings

* * * * *